US008081132B2

(12) United States Patent
Su

(10) Patent No.: US 8,081,132 B2
(45) Date of Patent: Dec. 20, 2011

(54) WIDEBAND ANTENNA FOR RECEIVING DIGITAL TV SIGNALS

(75) Inventor: Saou-Wen Su, Taipei (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 346 days.

(21) Appl. No.: 12/559,786

(22) Filed: Sep. 15, 2009

(65) Prior Publication Data

US 2010/0309083 A1 Dec. 9, 2010

(30) Foreign Application Priority Data

Jun. 9, 2009 (CN) ..... 2009 1 0145492

(51) Int. Cl.
*H01Q 9/44* (2006.01)

(52) U.S. Cl. ..... 343/805; 343/793; 343/882

(58) Field of Classification Search ..... 343/702, 343/703, 805, 860, 882
See application file for complete search history.

(56) References Cited

U.S. PATENT DOCUMENTS

| | | | | |
|---|---|---|---|---|
| 2,753,557 | A * | 7/1956 | Middlemark | 343/805 |
| 2,969,543 | A * | 1/1961 | Cushing et al. | 343/805 |
| 3,045,240 | A * | 7/1962 | Raynor | 343/805 |
| 3,579,241 | A * | 5/1971 | Antista et al. | 343/702 |
| 3,739,388 | A * | 6/1973 | Callaghan | 343/726 |

* cited by examiner

*Primary Examiner* — Tan Ho
(74) *Attorney, Agent, or Firm* — Rabin & Berdo, P.C.

(57) ABSTRACT

A wideband antenna for receiving digital television signals includes a substrate, a radiating plate, a first radiating element, and a second radiating element. The radiating plate is formed on the substrate and the radiating plate has a first radiating area, a second radiating area and a slit formed between the first and the second radiating areas. The first and the second radiating elements are pivotedly connected to the radiating plate. The first radiating element and the second radiating element are constructed as a dipole antenna structure of the antenna so as to excite a first resonant mode. The radiating plate also acts as a matching circuit thereon so as to excite a second resonant mode. The center frequency of the second resonant mode is shifted toward the center frequency of the first resonant mode with the incorporation of the radiating plate so that the antenna has a wideband characteristic.

22 Claims, 6 Drawing Sheets

WIDEBAND ANTENNA FOR RECEIVING DIGITAL TV SIGNALS

BACKGROUND OF THE INVENTION

1. Field of the Invention

The present invention relates to a wideband antenna for receiving digital TV signals, and more particularly to a digital TV antenna with a wideband characteristic and the antenna can easily be adjusted.

2. Description of Related Art

In the recent, the application of mobile media device is increasing. For example, the digital TV is widely used for providing user various functions. The car receiving system is used for presenting digital TV in cars to passengers. Home users can watch sport programs any time or choose a program by the VOD system (Video On Demand). Conventional receiving apparatus of digital TV usually has a receiving antenna for receiving the signals of digital TV programs. For example, a monopole antenna of metal rod can be used in the USB TV-tuner dongle.

The height of the monopole antenna of metal rod is about 13 to 17 cm and the monopole antenna has a transmission line. The length of the transmission line is about 100 to 150 cm. However, the above-mentioned antenna is a narrow-band antenna and the impedance bandwidth of the antenna is about 100 to 200 MHz only. The bandwidth of the antenna cannot cover the wider band, such as digital TV frequency band of 470 to 862 MHz. Thus, the conventional narrow-band antenna cannot provide good performance in the area with low signal strength of the digital TV programs.

On the other hand, the exterior antenna for receiving digital TV signals further includes a planar dipole antenna. The bandwidth of the antenna cannot entirely cover the frequency band of the digital TV. Furthermore, because the antenna is fixed, the end user has to move the whole device for adjusting the position and angle of the antenna in order to receive signals with better quality. In other words, it is not convenient for the end user to adjust the antenna in the practice.

Hence, the inventors of the present invention believe that the shortcomings described above are able to be improved and finally suggest the present invention which is of a reasonable design and is an effective improvement based on deep research and thought.

SUMMARY OF THE INVENTION

A main object of the present invention is to provide a wideband antenna for receiving digital television signals. The antenna of the present invention is a hybrid dipole antenna with a built-in matching circuit of high order resonant mode. The dipole antenna structure and the matching circuit of high order resonant mode are integrally constructed as a UHF wideband antenna for improving the quality of the received digital TV signals.

To achieve the above-mentioned objects, a wideband antenna in accordance with the present invention is provided. The wideband antenna for receiving digital television signals includes a substrate, a radiating plate, a first radiating element, and a second radiating element. The radiating plate is formed on the substrate and the radiating plate has a first radiating area, a second radiating area and a slit formed between the first radiating area and the second radiating area. The first radiating area has a first feed point and a first connection point, and the second radiating area has a second connection point and a second feed point corresponding to the first feed point. The slit has at least one bent portion and extends between the first radiating area and the second radiating area. The first radiating element is pivotedly connected to the first connection point so that the first radiating element is capable of being rotated relative to the radiating plate. The second radiating element is pivotedly connected to the second connection point so that the second radiating element is capable of being rotated relative to the radiating plate. The first radiating element and the second radiating element are constructed as a dipole antenna structure of the wideband antenna so as to excite a first resonant mode. The radiating plate including a first radiating area, a second radiating area and a slit acts as a matching circuit thereon so as to excite a second resonant mode. The center frequency of the second resonant mode is shifted toward the center frequency of the first resonant mode with the incorporation of the matching circuit of the radiating plate so that the antenna has a wideband characteristic.

Based on the above-mentioned structure, the first radiating area, the second radiating area and the slit of the radiating plate are functioning as a matching circuit to excite the high order resonant mode (second resonant mode). The matching circuit is further integrated with the dipole metal rods so that the high order resonant mode is excited and is combined with the fundamental resonant mode (first resonant mode). Therefore, the antenna can have a wideband characteristic for digital television signal reception. Moreover, the angle and the position of the antenna of the present invention can easily be adjusted for improving the quality of signals and the antenna is easily collected.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
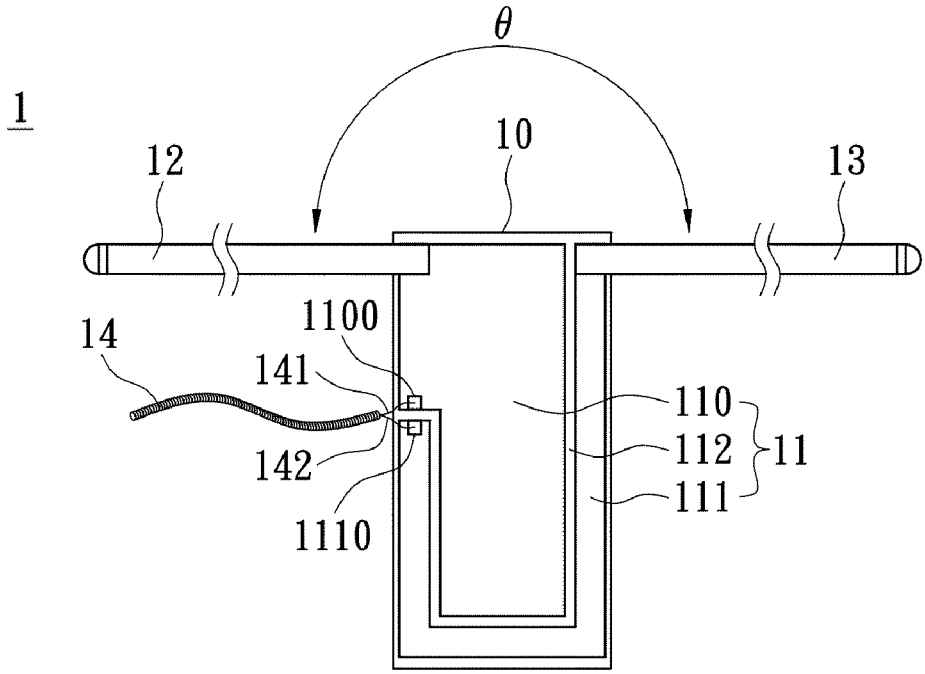
FIGS. 1 and 1A are schematic views of a wideband antenna for receiving digital TV signals of a first embodiment of the present invention.
Figure 1A:
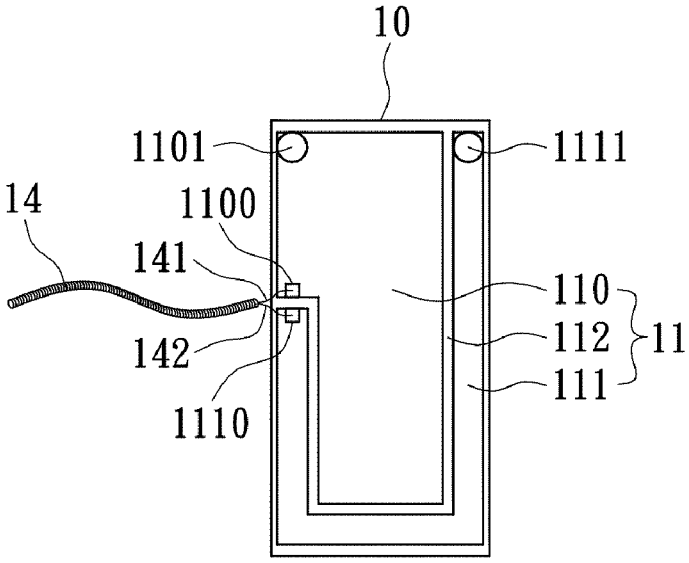

Please refer to FIGS. 1 and 1A; the present invention provides a wideband antenna 1 for receiving digital television signals. The antenna 1 has a matching circuit of high order resonant mode in coordination with the rotatable and retractable metal rod(s) so that the antenna 1 has a wideband characteristic for receiving digital television signals. The antenna 1 has a substrate 10, a radiating plate 11, a first radiating element 12 and a second radiating element 13.

The substrate 10 is used as a carrier and the radiating plate 11 is formed on the substrate 10. Furthermore, the first radiating element 12 and the second radiating element 13 are pivotally connected to the substrate 10. In one embodiment, the substrate 10 is a dielectric substrate, for example, the substrate 10 is made of FR4 dielectric material.

The radiating plate 11 is formed on an inner surface of the substrate 10. The radiating plate 11 has a first radiating area 110, a second radiating area 111 and a slit 112 formed between the first radiating area 110 and the second radiating area 111. In this embodiment, the first radiating area 110 and the second radiating area 111 are located on the same horizontal layer. The first radiating area 110, the second radiating area 111 and the slit 112 are functioning as a matching circuit to excite a second resonant mode (i.e., the resonant mode at higher frequencies). In addition, the slit 112 is extending between the first radiating area 110 and the second radiating area 111 and has at least one bent portion so that the effective resonant path and excited surface current path of the second resonant mode of the antenna structure can be lengthened. Therefore, the operating frequency of the second resonant mode is largely decreased.

On the other hand, the first radiating area 110 has a first feed point 1100 and a first connection point 1101, and the second radiating area 111 has a second feed point 1110 and a second connection point 1111. The position of the second feed point 1110 is corresponding to the position of the first feed point 1100 so as to feed signal. In addition, the antenna 1 further has a feeding coaxial cable 14 which has a core conductor 141 and a grounding conductor 142. The core conductor 141 and the grounding conductor 142 are respectively connected to the first feed point 1100 and the second feed point 1110.

Figure 8:
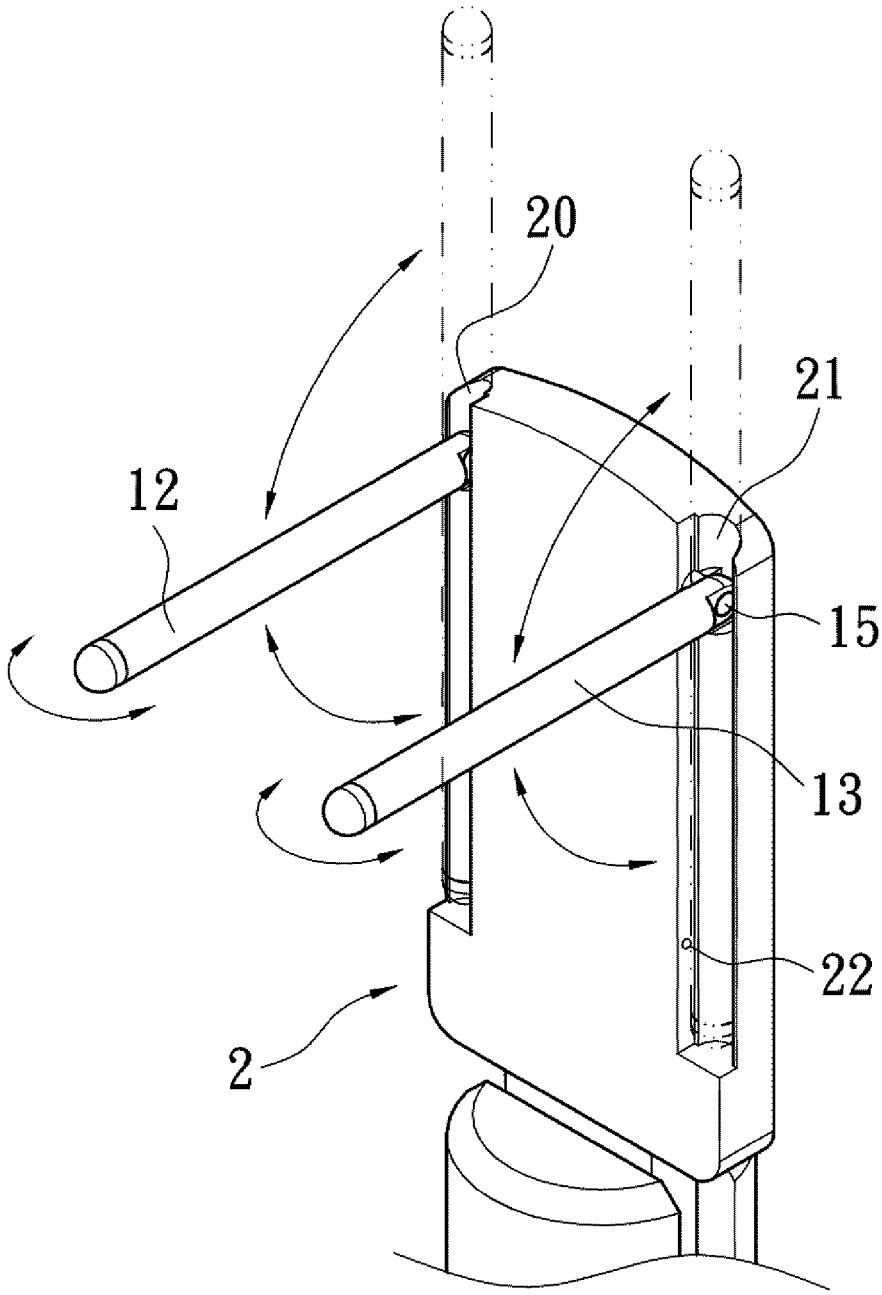

Moreover, the first radiating element 12 is pivotedly connected to the first connection point 1101 via a linkage 15 having pivoted means (as shown in FIG. 8). Similarly, the second radiating element 13 is pivotedly connected to the second connection point 1111 via the linkage 15 having pivoted means. Both of the first radiating element 12 and the second radiating element 13 are retractable and rotatable rods, and the first radiating element 12 and the second radiating element 13 are constructed as a dipole antenna structure. Therefore, a first resonant mode (fundamental resonant mode) is excited via the first radiating element 12 and the second radiating element 13. On the other hand, a second resonant mode (high order resonant mode) can be excited via the matching circuit of the radiating plate 11. The antenna 1 of the present invention is provided for lowering and shifting the center frequency of the second resonant mode (high order resonant mode) toward the center frequency of the first resonant mode (fundamental resonant mode) so that antenna 1 can have a wideband characteristic for receiving the digital television signals. The first radiating element 12 and the second radiating element 13 perform as the dipole antenna structure of the antenna 1. Moreover, the first radiating element 12 and the second radiating element 13 are capable of pivoting between open and closed positions. The linkage 15 includes pivoted means for raising the dipole antenna structure from a retracted position to an elevated position, and the linkage is connected to the dipole antenna structure such that the dipoles are automatically positioned to the open signal receiving position upon the first radiating element 12 and the second radiating element 13 being elevated, and are pivoted to a closed position upon the first radiating element 12 and the second radiating element 13 being descended and in general alignment with the radiating plate 11 in the retracted position. Due to the retractable and rotatable dipole antenna structure used in the antenna 1 of the present invention, the first radiating element 12 and the second radiating element 13 are easy for full adjusting the angle and position of the dipole antenna structure to receive the signals of better quality. Thus, the problem of poor signal strength for the reason that it is not convenient for adjusting the position of the conventional planar and fixed dipole antenna structure is solved.

Please refer to FIG. 1 again; the first embodiment of the present invention in shown. Both of the first radiating area 110, the second radiating area 111 are metal structures which are disposed on the same surface of the substrate 10. The slit 112 is formed as a U-shaped structure between the first radiating area 110 and the second radiating area 111. The slit 112 is a structure with unequal width and the width of the slit 112 of the embodiment is from 0.3 mm to 5 mm. By shaping the slit 112, the areas and the shapes of the first radiating area 110 and the second radiating area 111 can be adjusted. In the embodiment, the first radiating area 110 is a polygonal metal structure and the second radiating area 111 is a metal strap structure with equal width. Furthermore, the area of the first radiating area 110 is larger than that of the second radiating area 111. However, the structures of the first radiating area 110 and the second radiating area 111 are not restricted thereby. For example, the first radiating area 110 can be an irregular polygonal metal structure and the second radiating area 111 can be a metal strap structure with unequal width.

The slit 112 is introduced in the orientation of FIG. 1. The substrate 10 is shown as a rectangular structure with two long edges and two short edges. One terminal of the slit 112 is located on one long edge of the substrate 10. The slit 112 is formed by extending from the terminal on the long edge of the substrate 10 toward the bottom of the substrate 10, and bent parallel to the short edge of the substrate 10, and then bent toward the top of the substrate 10 so as to locate the other terminal of the slit 112 close to one short edge of the substrate 10. Accordingly, the slit 112 is formed as a U-shaped structure. On the other hand, the first feed point 1100 and the second feed point 1110 are correspondingly disposed near the one terminal of the slit 112, which is located on the long edge of the substrate 10. Moreover, the core conductor 141 of feeding coaxial cable 14 is connected to the first feed point 1100 and the grounding conductor 142 of feeding coaxial cable 14 is connected to the second feed point 1110.

Furthermore, the first connection point 1101 is located adjacent to a top side of the first radiating area 110 and the second connection point 1111 is located adjacent to a top side of the second radiating area 111. The first connection point 1101 and the second connection point 1111 are disposed approximately to a same horizontal level but they are located away from each other. For example, the first connection point 1101 and the second connection point 1111 are located adjacent to a top edge of the substrate 10 (i.e., they are disposed approximately to a same horizontal level), and the first connection point 1101 and the second connection point 1111 are respectively located at the two upper corners of the substrate 10 (i.e., they are disposed away from each other). As above-mentioned, the first radiating element 12 is pivotedly connected to the first connection point 1101 and the second radiating element 13 is pivotedly connected to the second connection point 1111. In other words, the first radiating element 12 can be rotated in 2-dimension or 3-dimension relative to the first connection point 1101. Similarly, the second radiating element 13 can be rotated in 2-dimension or 3-dimension relative to the second connection point 1111. Therefore, the angles of the first radiating element 12 and the second radiating element 13 can be full adjusted so as to receive signals of better quality depending on the antenna polarization condition.

Figure 4:
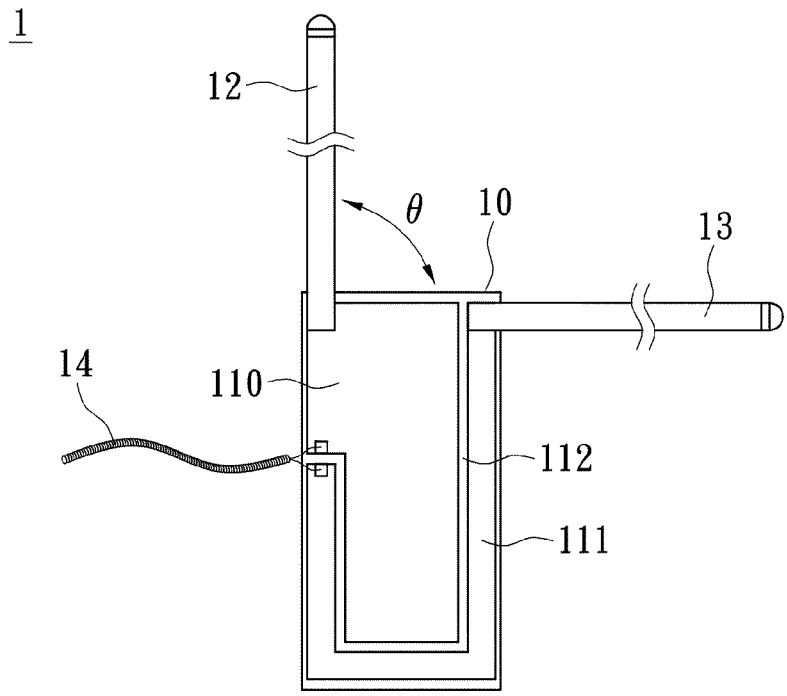
FIG. 4 is a schematic view showing the different included angle between the first radiating element and the second radiating element according to the present invention.

Please refer to FIGS. 1 and 4, there is an included angle θ between the center axis of the first radiating element 12 and the center axis of the second radiating element 13. In this embodiment, the included angle θ is 180 degrees on a predetermined plane as shown in FIG. 1, for example the predetermined plane can be parallel to the substrate 10 so as to receive signals of better quality. FIG. 4 illustrates another embodiment of the present invention which shows the included angle θ between the first radiating element 12 and the second radiating element 13 is 90 degrees. Because both the first radiating element 12 and the second radiating element 13 can rotate in 3-dimension, the included angle θ between the first radiating element 12 and the second radiating element 13 cannot be defined when the first radiating element 12 and the second radiating element 13 are not located on the same plane. Thus, in the embodiments, the included angle θ is calculated when the first radiating element 12 and the second radiating element 13 are located on the same plane and is defined as the angle between the center axis of the first radiating element 12 and the center axis of the second radiating element 13. In other words, the first radiating element 12 and the second radiating element 13 are located on the same plane which is parallel to the substrate 10 in the embodiments as shown in FIGS. 1 and 4, and the included angle θ can be ranged from 45 degrees to 180 degrees. However, the included angle θ between the first radiating element 12 and the second radiating element 13 are not restricted thereby. As above-mentioned, the matching circuit of the radiating plate 11 and the dipole antenna structure of metal rods (i.e., the first radiating element 12 and the second radiating element 13) are combined integrally. The first resonant mode (fundamental resonant mode) is excited by the dipole antenna structure, the second resonant mode (high order resonant mode) is excited by the matching circuit of the radiating plate 11, and the first radiating element 12 and the second radiating element 13 are pivotedly connected to the radiating plate 11 so that the antenna 1 can have a wideband characteristic for receiving the digital TV signals and the first radiating element 12 and the second radiating element 13 can be efficiently adjusted for improving quality of the received digital TV signals.

Figure 2:
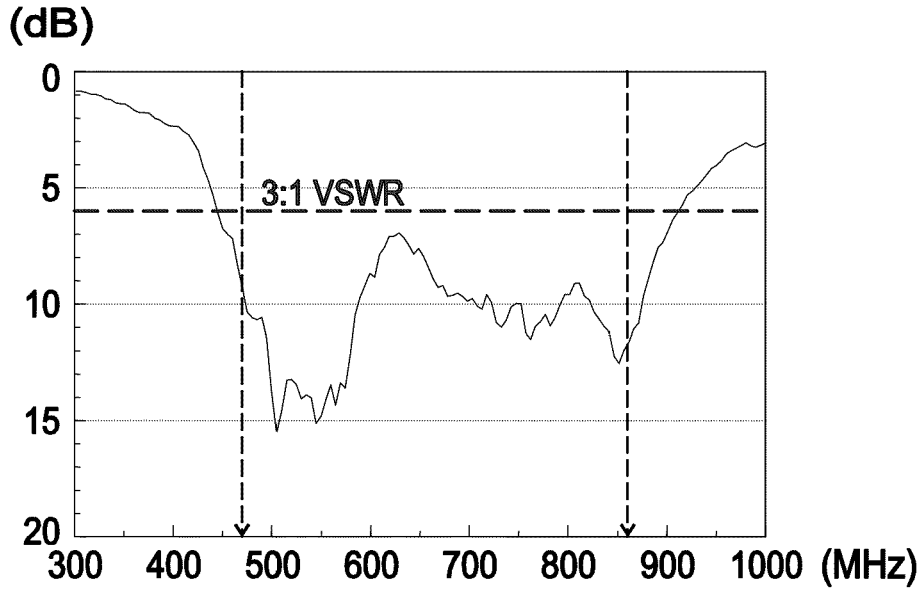
FIG. 2 is a measured schematic diagram of return loss against frequency of the wideband antenna for receiving digital TV signals according to the present invention.
Figure 3:
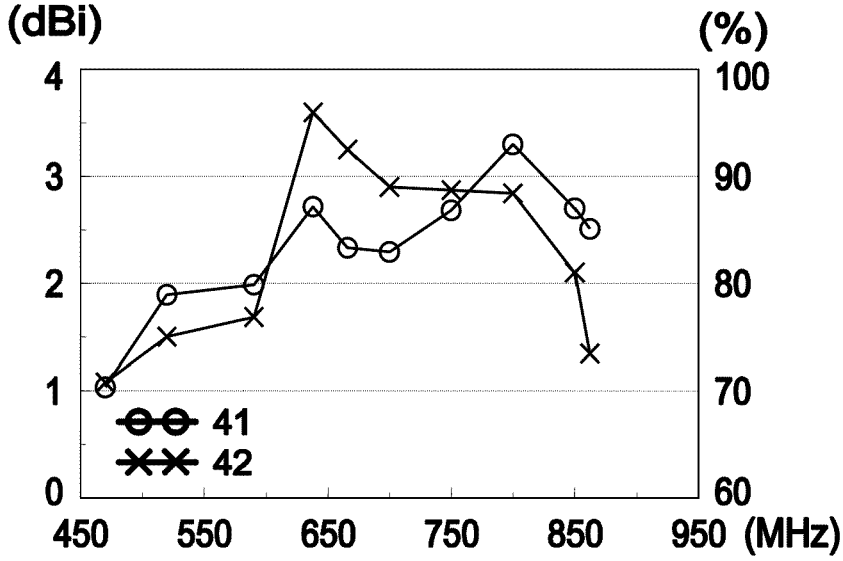
FIG. 3 is a curve diagram of the peak antenna gain (dBi) and the radiation efficiency (%) of the wideband antenna for receiving digital TV signals according to the present invention.
Figure 9:
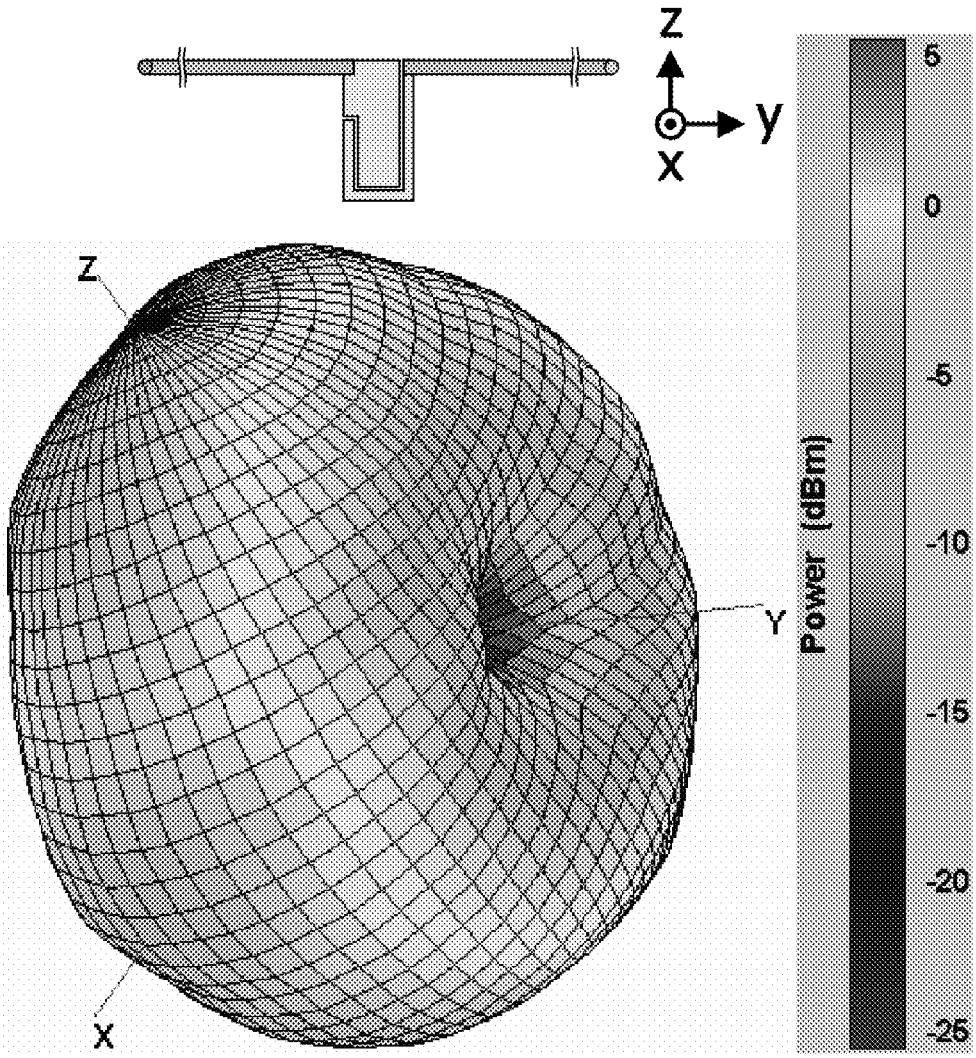
FIG. 9 shows the 3-dimension radiation pattern when the wideband antenna operates at 666 MHz according to the present invention.

Please refer to FIGS. 2, 3, and 9. The characteristics of the antenna 1 of the present invention are described. FIG. 2 shows a measured schematic diagram of return loss according to the present invention. An operating bandwidth of the UHF (470 to 862 MHz) band of the wideband antenna is indicated with the definition of 3:1 VSWR and the bandwidth can cover digital TV channels in most area. FIG. 3 is a curve diagram of the peak antenna gain (dBi) and the radiation efficiency (%) of the present invention. The peak antenna gain curve 41 and radiation efficiency curve 42 of the antenna 1 are shown in FIG. 3. The gain of the antenna 1 ranges from 1 dBi to 3 dBi in the bandwidth of digital TV. The radiation efficiency of the antenna 1 is above 70% in the digital TV bandwidth. Therefore, the antenna 1 of the present invention is qualified for receiving the signals of digital TV. FIG. 9 shows the 3-dimension radiation pattern when the antenna 1 operates at 666 MHz according to the present invention. Please refer FIG. 9 and take the gain curve 41 of FIG. 3 as reference, the gain of the antenna 1 ranges from 2 dBi to 3 dBi. Based on the results above-mentioned, a second resonant mode (high order resonant mode) can be excited with the matching circuit of the radiating plate 11 and the center frequency of the second resonant mode is shifted toward the center frequency of the first resonant mode (fundamental resonant mode) so that antenna 1 can have a wideband characteristic for receiving the digital television signals.

Figure 6:
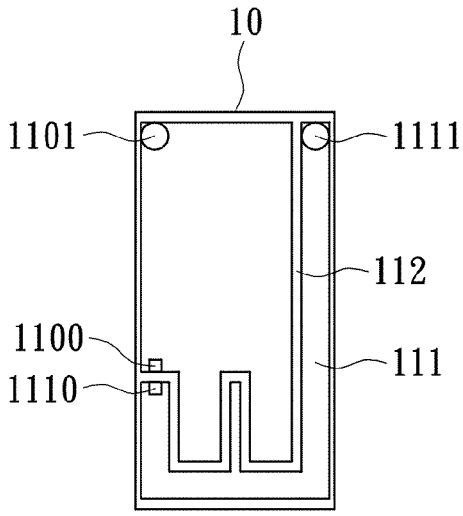
FIG. 6 is a schematic view of a wideband antenna for receiving digital TV signals of a third embodiment of the present invention.
Figure 5:
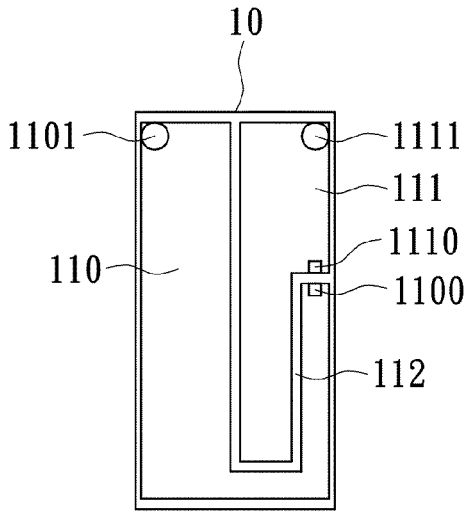
FIG. 5 is a schematic view of a wideband antenna for receiving digital TV signals of a second embodiment of the present invention.

Please refer to FIG. 5 illustrating the second embodiment of the present invention. In the embodiment, the slit 112 is also formed as a U-shaped structure but the slit 112 is extending in the direction opposite to the extending direction of the first embodiment. The position of the slit 112 of the second embodiment is more close to the center portion of the substrate 10 so that the area of the first radiating area 110 is a little larger than that of the second radiating area 111. Please refer to FIG. 6 illustrating the third embodiment of the present invention. The slit 112 is formed as a W-shaped structure. Similar to the first embodiment, the W-shaped slit 112 is extending so that the effective resonant path and excited surface current path of the second resonant mode of the antenna structure can be lengthened and the operating frequency of the second resonant mode is largely decreased.

The slit 112 is formed in order to lengthen the effective resonant path and excited surface current path of the second resonant mode of the antenna 1 and decrease the operating frequency of the second resonant mode. The structure of the slit 112 is not restricted by the above-mentioned structures. For example, the slit 112 can be a structure with unequal width. The slit 112 has at least one bending feature to lengthen the path of the slit 112 and the path length is enough to be used for shifting the center frequency of the second resonant mode toward the center frequency of the first resonant mode. Thus, the antenna 1 can have a wideband characteristic for receiving the digital television signals.

Figure 7:
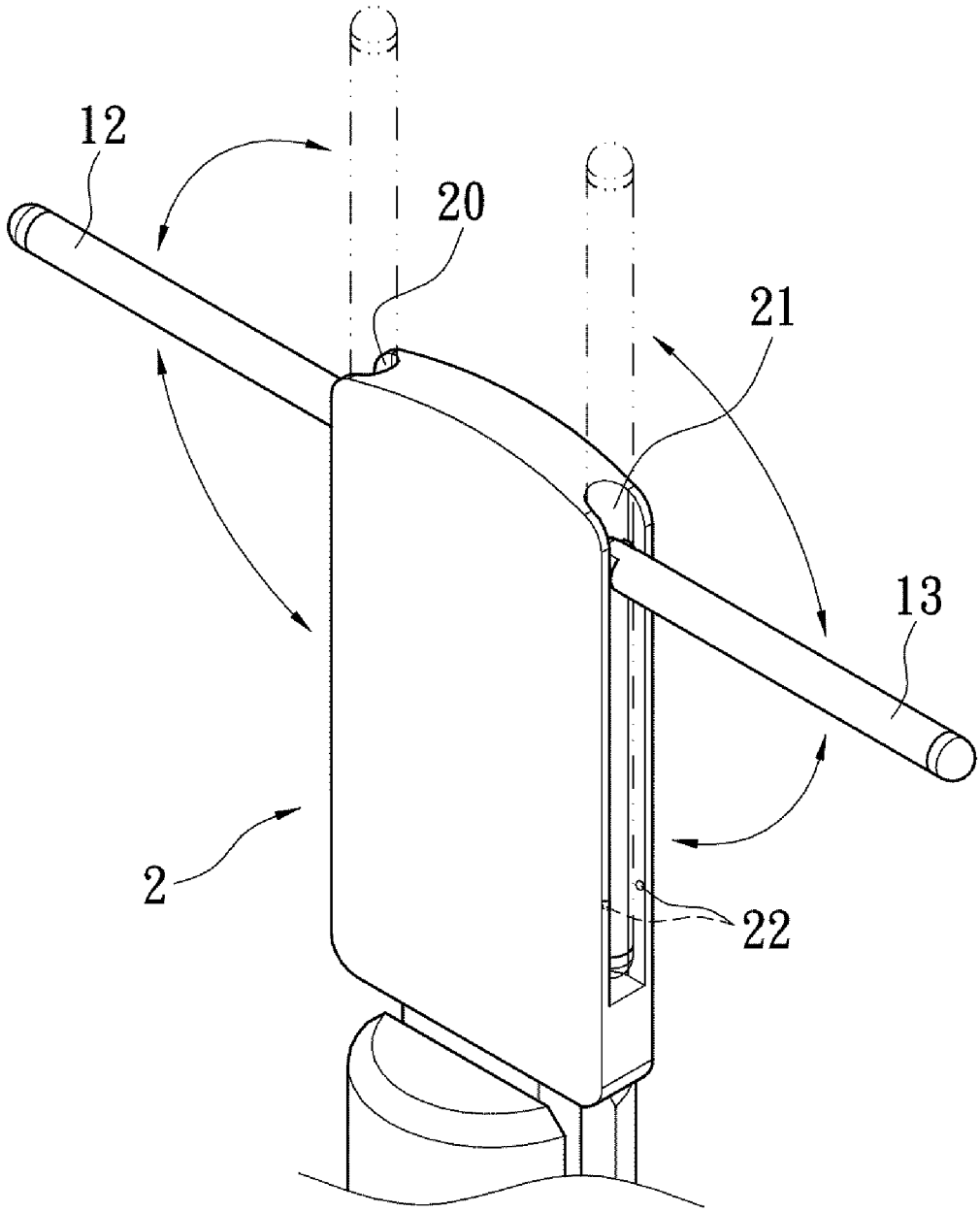
FIGS. 7 and 8 are schematic views showing the wideband antenna with the outer housing according to the present invention.

Please refer to FIGS. 7 and 8. The antenna 1 further has an outer housing 2. The substrate 10 is accommodated inside the outer housing 2 and the first and the second radiating elements 12, 13 penetrate through the outer housing 2 so that the first and the second radiating elements 12, 13 are exposed. Therefore, it is convenient for adjusting the angle and position of the first and the second radiating elements 12, 13, or for retracting/extending the lengths of the first and the second radiating elements 12, 13. Thus, the quality of the received signals of the antenna 1 is improved. Moreover, the outer housing 2 has a first receiving groove 20 and a second receiving groove 21 for receiving the first radiating element 12 and the second radiating element 13 respectively. The first radiating element 12 and the second radiating element 13 can be respectively accommodated in the first receiving groove 20 and the second receiving groove 21 when the antenna 1 is not in use. Thus, the first radiating element 12 and the second radiating element 13 can be protected from collision. Furthermore, the first receiving groove 20 has at least one positioning protrusion 22 on a side-wall of the first receiving groove 20. Similarly, the second receiving groove 21 has at least one positioning protrusion 22 on a side-wall of the second receiving groove 21. The positioning protrusion 22 is used for locking tightly the first radiating element 12 and the second radiating element 13 in the first receiving groove 20 and the second receiving groove 21. In this embodiment, the first receiving groove 20 and the second receiving groove 21 are formed on opposite sides of the outer housing 2, as shown in FIG. 7. Alternatively, the first receiving groove 20 and the second receiving groove 21 are formed on the same side of the outer housing 2, as shown in FIG. 8.

On the other hand, the first radiating element 12 and the second radiating element 13 are connected to the substrate 10 via pivoted means, such as spherical pivotal mechanism, pivotal joint and so on and the first radiating element 12 and the second radiating element 13 can be rotated via the pivoted means according to the application. Therefore, the quality of the receiving signal of the digital TV is improved and the antenna 1 can be easily collected and organized.

Consequently, the antenna 1 of the present invention has the beneficial effects as follows:

1. The present invention provides a hybrid antenna module which includes a substrate, a radiating plate functioning as matching circuit and dipole metal rods. Therefore, the matching circuit of high order resonant mode (second resonant mode) is integrated with the dipole retractable metal rods with the fundamental resonant mode (first resonant mode). In other words, the center frequency of the second resonant mode is shifted toward the center frequency of the first resonant mode of the dipole metal rods so that the antenna has a wideband characteristic for receiving the digital television signals.

2. The structure of the antenna of the present invention is simplified and the antenna has small volume. The positions and angles of the dipole metal rods can easily be adjusted for achieved better quality and antenna polarization condition of the received signals. On the other hand, the dipole metal rods can be accommodated in the receiving groove of the outer housing so that the antenna can easily be carried.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. An antenna for receiving digital television signals, comprising:

a substrate;

a radiating plate formed on the substrate, the radiating plate having a first radiating area, a second radiating area and a slit formed between the first radiating area and the second radiating area, wherein the first radiating area includes a first feed point and a first connection point, the second radiating area includes a second connection point and a second feed point corresponding to the first feed point, the slit includes at least one bent portion and extends between the first radiating area and the second radiating area;

a first radiating element pivotedly connected to the first connection point so that the first radiating element is capable of being rotated relative to the radiating plate; and a second radiating element pivotedly connected to the second connection point so that the second radiating element is capable of being rotated relative to the radiating plate, wherein the first radiating element and the second radiating element are constructed as a dipole antenna structure of the antenna so as to excite a first resonant mode;

wherein the radiating plate acts as a matching circuit thereon so as to excite a second resonant mode, a center frequency of the second resonant mode is shifted toward a center frequency of the first resonant mode so that the antenna has a wideband characteristic.

2. The antenna for receiving digital television signals as claimed in claim 1, further comprising a feeding coaxial cable, wherein the feeding coaxial cable has a core conductor and a grounding conductor, the core conductor is electrically connected to the first feed point, and the grounding conductor is electrically connected to the second feed point.

3. The antenna for receiving digital television signals as claimed in claim 2, further comprising an outer housing, wherein the substrate is disposed inside the outer housing, and the first and the second radiating elements penetrate through the outer housing so that the first and the second radiating elements are exposed.

4. The antenna for receiving digital television signals as claimed in claim 3, wherein the first radiating element is a retractable rod which is capable of being three-dimensionally rotated relative to the first connection point, and the second radiating element is another retractable rod which is capable of being three-dimensionally rotated relative to the second connection point.

5. The antenna for receiving digital television signals as claimed in claim 1, wherein the first radiating element is a retractable rod which is capable of being three-dimensionally rotated relative to the first connection point, the second radiating element is another retractable rod which is capable of being three-dimensionally rotated relative to the second connection point.

6. The antenna for receiving digital television signals as claimed in claim 5, wherein the first radiating element and the second radiating element has an included angle therebetween on a predetermined plane, and the included angle is ranged from 45 degrees to 180 degrees.

7. The antenna for receiving digital television signals as claimed in claim 5, further comprising an outer housing, wherein the substrate is disposed inside the outer housing, and the first and the second radiating elements penetrate through the outer housing so that the first and the second radiating elements are exposed.

8. The antenna for receiving digital television signals as claimed in claim 7, wherein the outer housing has a first receiving groove and a second receiving groove for receiving the first radiating element and the second radiating element. short edges, one end of the slit is located on one of the long edges, and the other end of the slit is located on one of the short edges.

9. The antenna for receiving digital television signals as claimed in claim 8, wherein the first receiving groove and the second receiving groove are formed on opposite sides of the outer housing, or the first receiving groove and the second receiving groove are formed on a same side of the outer housing.

10. The antenna for receiving digital television signals as claimed in claim 8, wherein the first receiving groove has at least one positioning protrusion on a side-wall thereof and the second receiving groove has at least one positioning protrusion on a side-wall thereof.

11. The antenna for receiving digital television signals as claimed in claim 1, wherein the slit has a width and the width of the slit is ranged from 0.3 mm to 0.5 mm.

12. The antenna for receiving digital television signals as claimed in claim 1, wherein the slit has a length and the length of the slit is adjustable to change the center frequency of the second resonant mode of the antenna.

13. The antenna for receiving digital television signals as claimed in claim 12, wherein the slit is U-shaped or W-shaped.

14. The antenna for receiving digital television signals as claimed in claim 1, wherein the substrate is a rectangular structure with two long edges and two short edges, one end of the slit is located on one of the long edges, and the other end of the slit is located on one of the short edges.

15. The antenna for receiving digital television signals as claimed in claim 1, wherein the first connection point is located adjacent to a top side of the first radiating area, the second connection point is located adjacent to a top side of the second radiating area, and the first connection point and the second connection point are disposed approximately to a same horizontal level.

16. The antenna for receiving digital television signals as claimed in claim 1, wherein the first radiating area is larger than the second radiating area.

17. The antenna for receiving digital television signals as claimed in claim 16, wherein the first radiating area is a polygonal metal structure.

18. The antenna for receiving digital television signals as claimed in claim 17, wherein the second radiating area is a metal strap structure with equal width.

19. The antenna for receiving digital television signals as claimed in claim 16, wherein the first radiating area is an irregular polygonal metal structure.

20. The antenna for receiving digital television signals as claimed in claim 19, wherein the second radiating area is a metal strap structure with unequal width.

21. The antenna for receiving digital television signals as claimed in claim 1, further comprising an outer housing, wherein the substrate is disposed inside the outer housing, and the first and the second radiating elements penetrate through the outer housing so that the first and the second radiating elements are exposed.

22. The antenna for receiving digital television signals as claimed in claim 1, wherein the first radiating area and the second radiating area are located on a same horizontal layer.

* * * * *